US012616894B2

(12) United States Patent
Cook et al.

(10) Patent No.: US 12,616,894 B2
(45) Date of Patent: May 5, 2026

(54) ATTENDANT-FREE GAME MACHINE

(71) Applicant: Bob's Space Racers, Inc., Holly Hill, FL (US)

(72) Inventors: Jack Cook, Ormond Beach, FL (US); Joshua Peacock, Holly Hill, FL (US)

(73) Assignee: Bob's Space Racers, Inc., Holly Hill, FL (US)

( * ) Notice: Subject to any disclaimer, the term of this patent is extended or adjusted under 35 U.S.C. 154(b) by 626 days.

(21) Appl. No.: 17/988,506

(22) Filed: Nov. 16, 2022

(65) Prior Publication Data

US 2023/0149800 A1 May 18, 2023

Related U.S. Application Data

(60) Provisional application No. 63/280,108, filed on Nov. 16, 2021.

(51) Int. Cl.

| | |
|---|---|
| ***A63F 7/30*** | (2006.01) |
| ***A63F 7/06*** | (2006.01) |
| ***A63F 7/36*** | (2006.01) |

(52) U.S. Cl.

CPC ..... *A63F 7/30* (2013.01); *A63F 7/0612* (2013.01); *A63F 7/0664* (2013.01); *A63F 7/36* (2013.01); *A63F 2250/146* (2013.01)

(58) Field of Classification Search

CPC ..... A63F 7/30; A63F 7/36; A63F 7/00612; A63F 7/0064; A63B 67/002

See application file for complete search history.

(56) References Cited

U.S. PATENT DOCUMENTS 2,617,653 A * 11/1952 Keller ..... A63F 7/0612 473/433

3,362,712 A * 1/1968 Wagner ..... A63F 9/0204 273/374

(Continued)

OTHER PUBLICATIONS

Up for Auction: Collection of Carnival Knockdown Dolls published Apr. 10, 2012 and available online at https://amusingthezillion.com/tag/knockdown-dolls/ (Year: 2012).*

*Primary Examiner* — James S. McClellan

(74) *Attorney, Agent, or Firm* — Standley Law Group LLP; Jeffrey S. Standley; Kenny W. Pung

(57) ABSTRACT

An attendant-free midway-style electronic game machine. The game machine includes a predetermined number of projectiles for game play during a user game play session, a lower cabinet or first structural portion, a target cabinet or second structural portion having a target, and at least one detector. The lower cabinet may include a counter section and an elongated ramp section ending proximal to a user play position. The target cabinet may be located on top of the ramp section and spaced a distance from the counter section. At least one detector, which may be in the form of a sensor array, is configured to detect when an interruption occurs in the array indicating a projectile has passed by the detection area. The game machine may be configured to detect when a projectile has been actuated towards the target or has ricocheted off the target and is traveling towards the counter section. An electronic controller in electronic communication with said detector, may be configured to automatically end a game play session once a predetermined number of said game projectiles have been detected as having been actuated by a user toward said target.

17 Claims, 16 Drawing Sheets

(56) References Cited

U.S. PATENT DOCUMENTS

| | | | | |
|---|---|---|---|---|
| 4,013,292 | A * | 3/1977 | Cohen | A63B 69/0071 273/371 |
| 4,949,972 | A * | 8/1990 | Goodwin | F41J 5/02 273/408 |
| 5,230,505 | A * | 7/1993 | Paquet | A63B 69/0002 250/222.2 |
| 5,553,859 | A * | 9/1996 | Kelly | A63B 67/02 273/338 |
| 5,649,706 | A * | 7/1997 | Treat, Jr. | F41J 9/14 463/52 |
| 5,658,211 | A * | 8/1997 | Glover | A63F 7/06 473/422 |
| 11,688,236 | B2 | 6/2023 | Thoeni et al. | |
| 2022/0141550 | A1 | 5/2022 | Liu | |
| 2022/0296460 | A1 | 9/2022 | Liu et al. | |
| 2023/0039469 | A1 | 2/2023 | Liu et al. | |
| 2023/0112195 | A1 | 4/2023 | Davis | |
| 2024/0185666 | A1 | 6/2024 | Cook et al. | |

* cited by examiner

98

12.86
1.50
1.50
0.86
1.60
1.50
0.10
0.10
0.10

ATTENDANT-FREE GAME MACHINE

CROSS-REFERENCE TO RELATED APPLICATIONS

This application is a non-provisional patent application that makes a priority claim to U.S. Provisional Application No. 63/280,108, filed Nov. 16, 2021, the disclosures of which are hereby incorporated by reference as if fully restated herein.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD

The application relates to electronic game machines and, more particularly, to midway-style electronic game machines.

BACKGROUND

Amusement parks, theme parks, carnivals, family entertainment centers, festivals, fairs (e.g., county or state fairs), and the like often feature one or more areas with clusters of carnival games, amusement rides, and other similar types of entertainment attractions. These areas are commonly known as a "midway."

One popular type of carnival game that is often played in midways is the game of skill that involves having players test their aim at hitting a target by launching, shooting, or throwing some sort of projectile like a ball, dart, or weapon. Some games of this type are the "Cross Bow Shoot", the "Milk Bottle" game, or the "Balloon and Dart" game. Basketball shooting games can also be considered in this genre as well. Collectively, these types of games can be considered "midway-style games."

Midway-style games generally require an attendant to administer and oversee the game. Among other things, the attendant can receive payment from players, keep score, and distribute prizes. Crucially, attendants can also prevent players from cheating by keeping track of the number of authorized attempts a player has taken and denying any unauthorized attempts. Players of midway-style games generally pay for a limited number of attempts or a limited timeframe to make as many attempts as possible.

Those skilled in the art will appreciate, however, that the need for an attendant can be a major drawback to the commercialization of midway-style games. To hire an attendant is to incur labor costs, and that's only if staffing is reliable. Therefore, what is needed is a way to play midway-style games without an attendant. The present disclosure relates to a midway-style electronic game machine capable of doing so.

SUMMARY OF THE INVENTION

Disclosed are game machines that include game projectiles, one or more structural portions that may define a lower cabinet and a target cabinet, a controller, and at least one detector.

In one embodiment, the game machine includes a lower cabinet that includes a counter section and an elongated ramp section, with the ramp section extending backwards relative to the counter section. The game machine also includes a target cabinet located on top of the ramp section and spaced a distance from the counter section. The game machine further includes at least one sensor array configured to detect interruptions in a detection area located between the counter section and the target cabinet.

In another embodiment, the game machine includes a lower cabinet that includes a counter section and an elongated ramp section, with the ramp section extending backwards relative to the counter section. The game machine also includes a target cabinet located on top of the ramp section and spaced a distance from the counter section. The game machine further includes a first sensor array configured to detect when an interruption occurs in a first detection area located between the counter section and the target cabinet. The game machine yet further includes a second sensor array configured to detect when an interruption occurs in a second detection area located between the first detection plane and the target cabinet.

In yet another embodiment, the game machine includes a lower cabinet that includes a counter section and an elongated ramp section, with the ramp section extending backwards relative to the counter section. The game machine also includes a target cabinet located on top of the ramp section and spaced a distance from the counter section. The target cabinet includes a forward-facing side, a target disposed on the forward-facing side, and a made-shot sensor operatively connected to the target for detecting when a player has made a successful attempt. The game machine further includes at least one sensor array configured to detect interruptions in a detection area located between the counter section and the target cabinet.

Other examples of the disclosed game machine will become apparent from the following detailed description, the accompanying drawings, and the appended claims.

DETAILED DESCRIPTION

Figure 1:
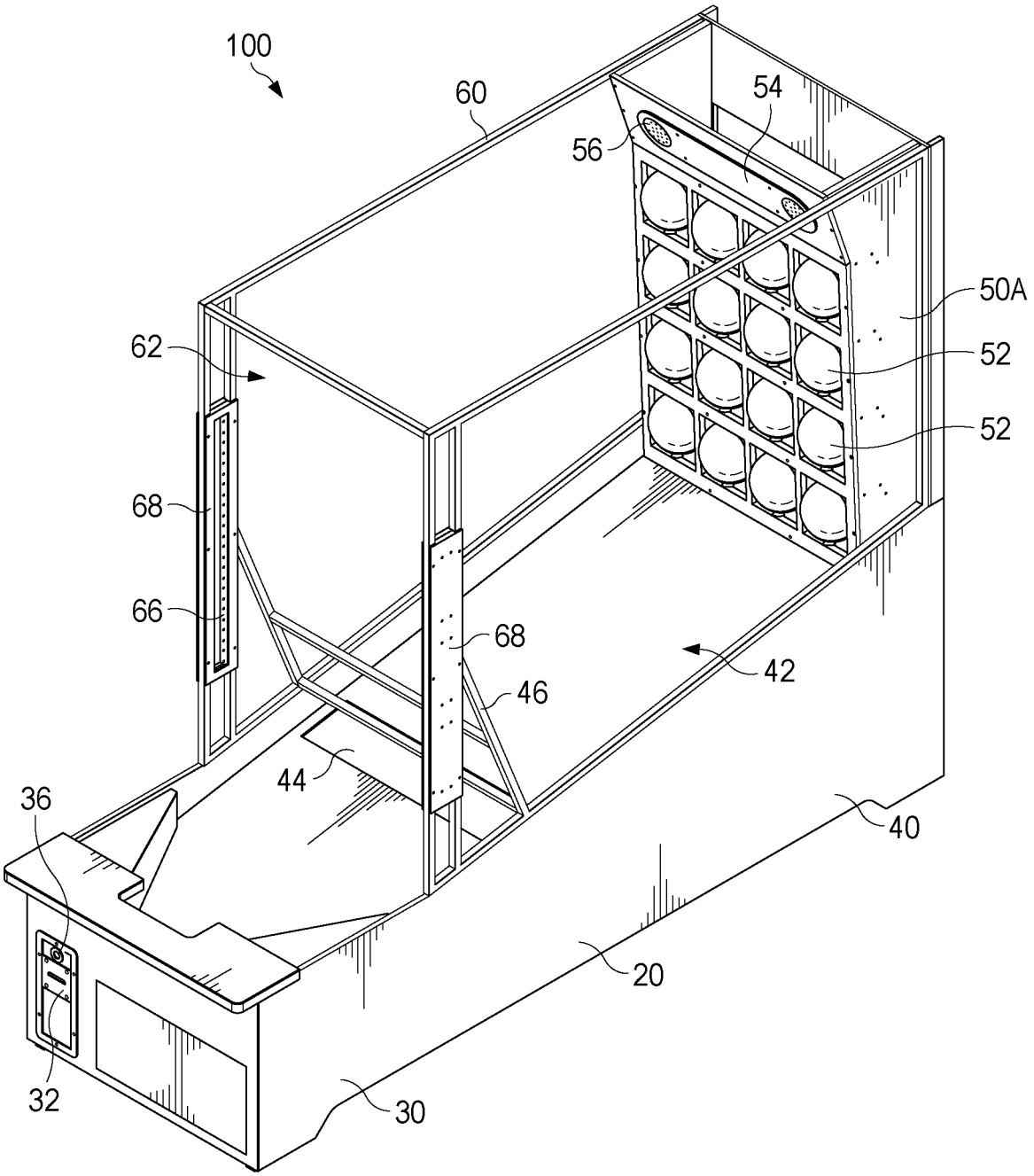
FIG. 1 is a front perspective view of a first exemplary embodiment of a midway-style electronic game machine.

The following detailed description refers to the accompanying drawings, which illustrate specific examples described by the disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according the present disclosure are provided below. Reference herein to "example" means that one or more feature, structure, element, component, characteristic and/or operational step described in connection with the example is included in at least one embodiment and/or implementation of the subject matter according to the present disclosure. Thus, the phrase "an example" and similar language throughout the present disclosure may, but do not necessarily, refer to the same example. Further, the subject matter characterizing any one example may, but does not necessarily, include the subject matter characterizing any other example.

Referring to FIGS. 1-5, the present disclosure provides an exemplary embodiment of a midway-style electronic game machine apparatus 100 (herein, the "machine"). The machine 100 preferably includes a first structural portion or lower cabinet 20, a second structural portion or target cabinet (referred to generally with ref. no. 50 but shown in the FIGS. as 50A-D), and in a preferred embodiment a frame 60. The lower cabinet 20 may include forward counter section 30 and a rear ramp section 40. The ramp section may be elongated, extending relative to the counter section 30, and define an upward slope from front to rear. The target cabinet 50 is located towards the rear of the lower cabinet 20, which in some embodiments may be the highest point along the ramp section 40. The frame 60 is located above the lower cabinet 20 and defines a passing lane 62 between the counter section 30 and the target cabinet 50 (best shown in FIG. 4). Players can position themselves in a user play position in front of the counter section 30 and attempt to hit a target (referred to generally with ref. no. 52 but shown in the FIGS. as 52A-D) included on or defined in the target cabinet 50 by throwing, shooting, or otherwise launching/actuating game projectiles through the passing lane 62. After hitting the target cabinet 50, the projectiles can then fall onto the ramp section 40 and roll down to the counter section 30 back to the player.

In exemplary embodiments, the machine 100 may define a gather area 42 on the ramp section 40 where projectiles can gather after a player has launched or thrown them through the passing lane 62. The gather area 42 may include a gate 44 that obstructs the flow of projectiles down the ramp section 40, thereby preventing them from reaching the counter section 30. The gate 44 may extend across the width of the ramp section 40. The gate 44 may be configured to pivot upwards to stop projectiles from traveling down the ramp section 40 (e.g., after a certain number of authorized attempts has been made or after a certain amount of time has elapsed), and may pivot downwards (until it is flush with the top surface of the ramp section 40) to permit gathered projectiles to travel to the counter section 30. The machine 100 may also include a guard 46 positioned above the gate 44 to prevent players from reaching in and taking projectiles out of the gather area 42.

Those skilled in the art will appreciate that although the gate 44 shown in FIGS. 1-5 is considered exemplary, it is not meant to be limiting. It is contemplated that different types of gates, including gates that are not integrated into the ramp section or gates that do not pivot upwards and downwards may also be utilized. Variations such as these will not result in a departure from the scope of the present disclosure.

In exemplary embodiments, the counter section 30 of the machine 100 may include a payment device 32 for receiving payment from a player. The payment device 32 may be configured to verify if the correct amount has been presented. The payment device 32 is not limited to any particular type of currency and can be configured to operate with, for example, coins, bills, and/or cards. In a preferred embodiment, the payment mechanism 32 may include a card reader for receiving payment.

In exemplary embodiments, the counter section 30 of the machine 100 may include a game start device 36. The game start device 36 may comprise a user-actuatable means such as a push button or a touch screen. A player may engage the game start device 36 to begin play of the machine 100. In example, a player may engage the game start device 36 to cause the gate 44 to pivot downwards and release projectiles. A predetermined number of game projectiles for a game play session, may be provided to the user, and accessible at a user game play position to begin the game play session.

In exemplary embodiment, the counter section 30 of the machine 100 may include a reward dispenser for dispensing rewards earned for playing the game machine. For example, the reward dispenser may be a ticket dispenser that is configured to dispense tickets that the player can later redeem for prizes. These tickets can be of any size, shape, or variety. It is contemplated that the machine 100 does not need to be limited to any particular type of reward dispenser, and that different types of reward dispensers may be utilized without departing from the scope of the present disclosure.

Figure 6:
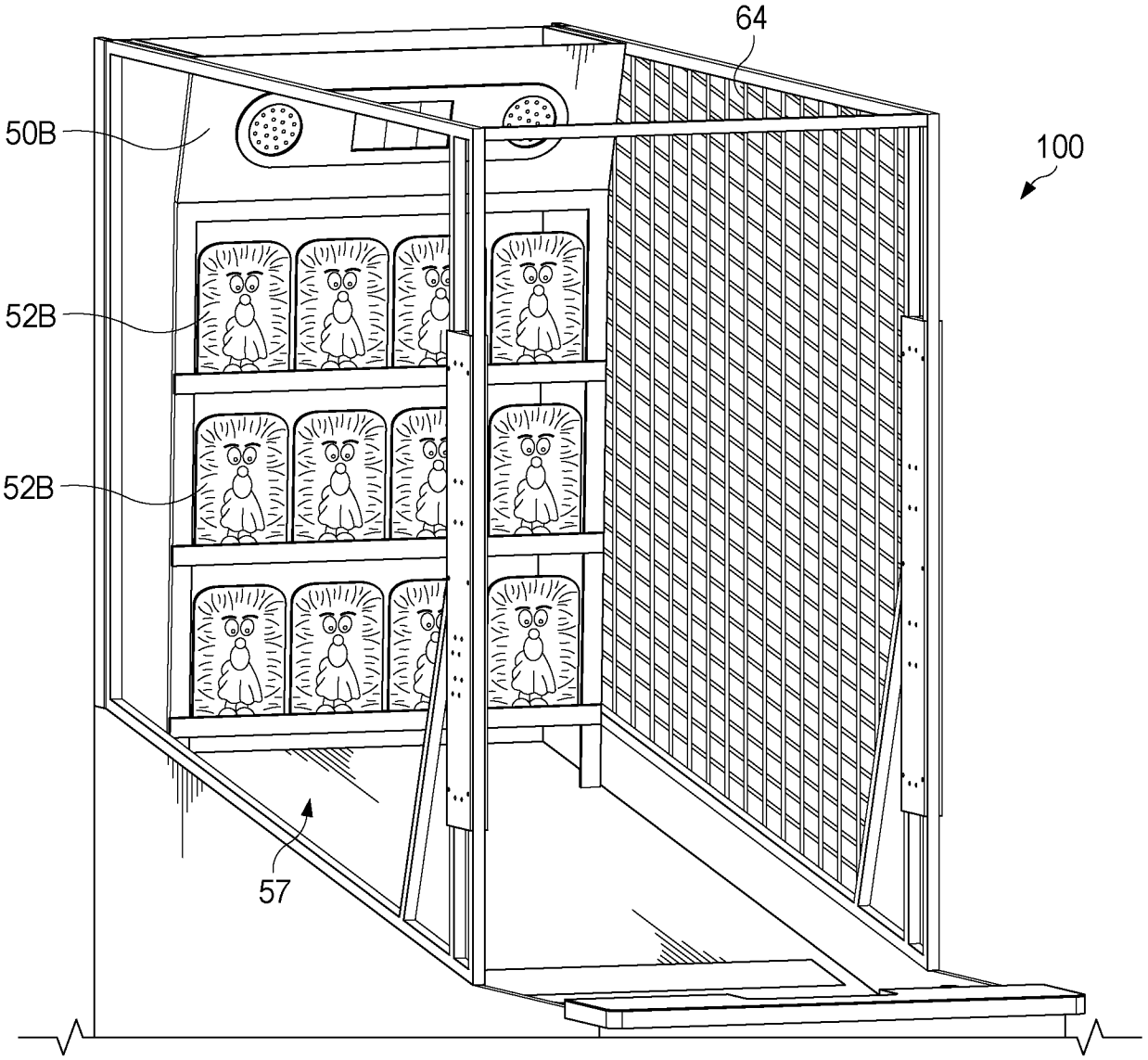
FIG. 6 is front perspective view of a second exemplary embodiment of a midway-style electronic game machine.
Figure 7:
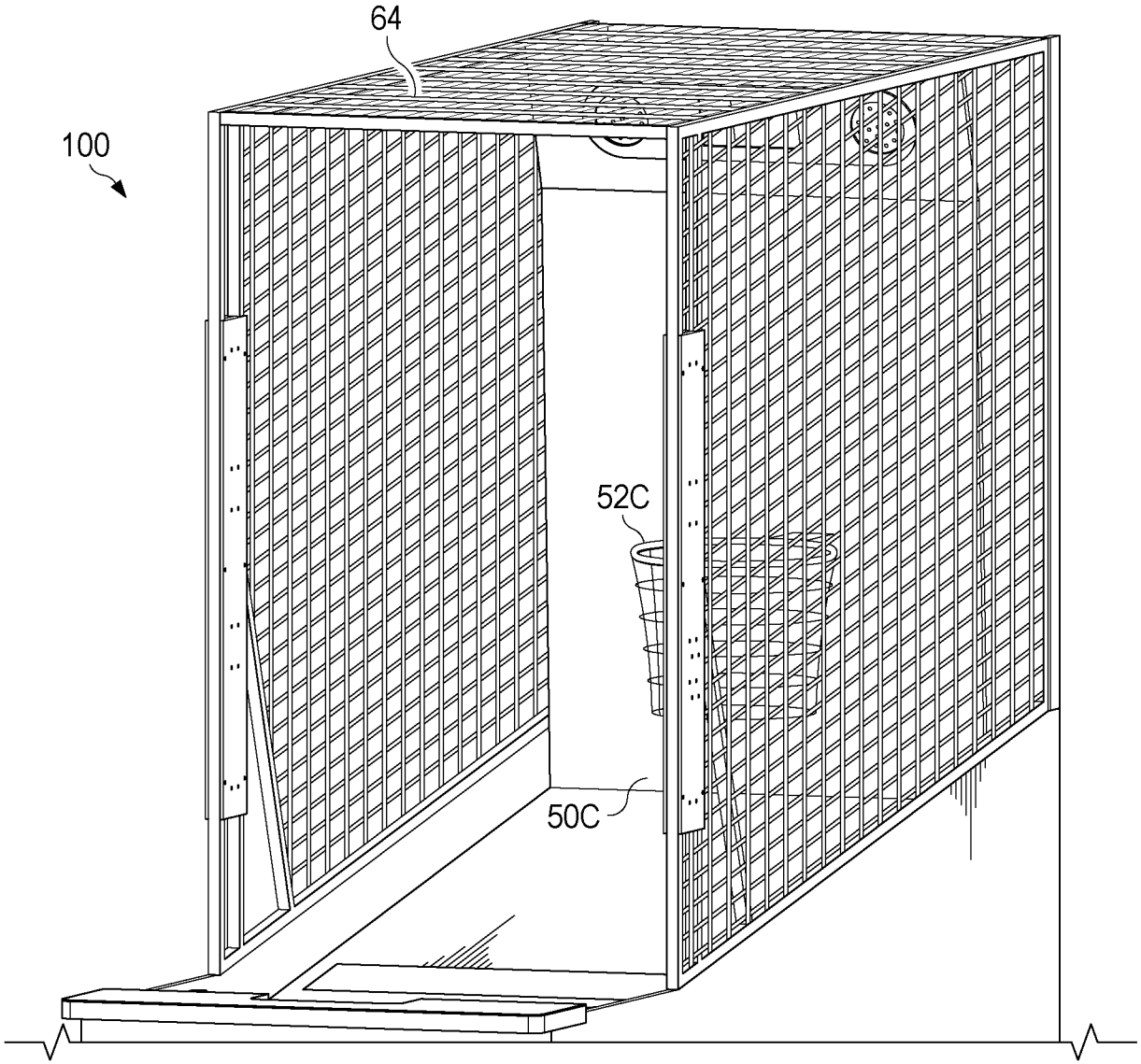
FIG. 7 is a front perspective view of a third exemplary embodiment of a midway-style electronic game machine.
Figure 8:
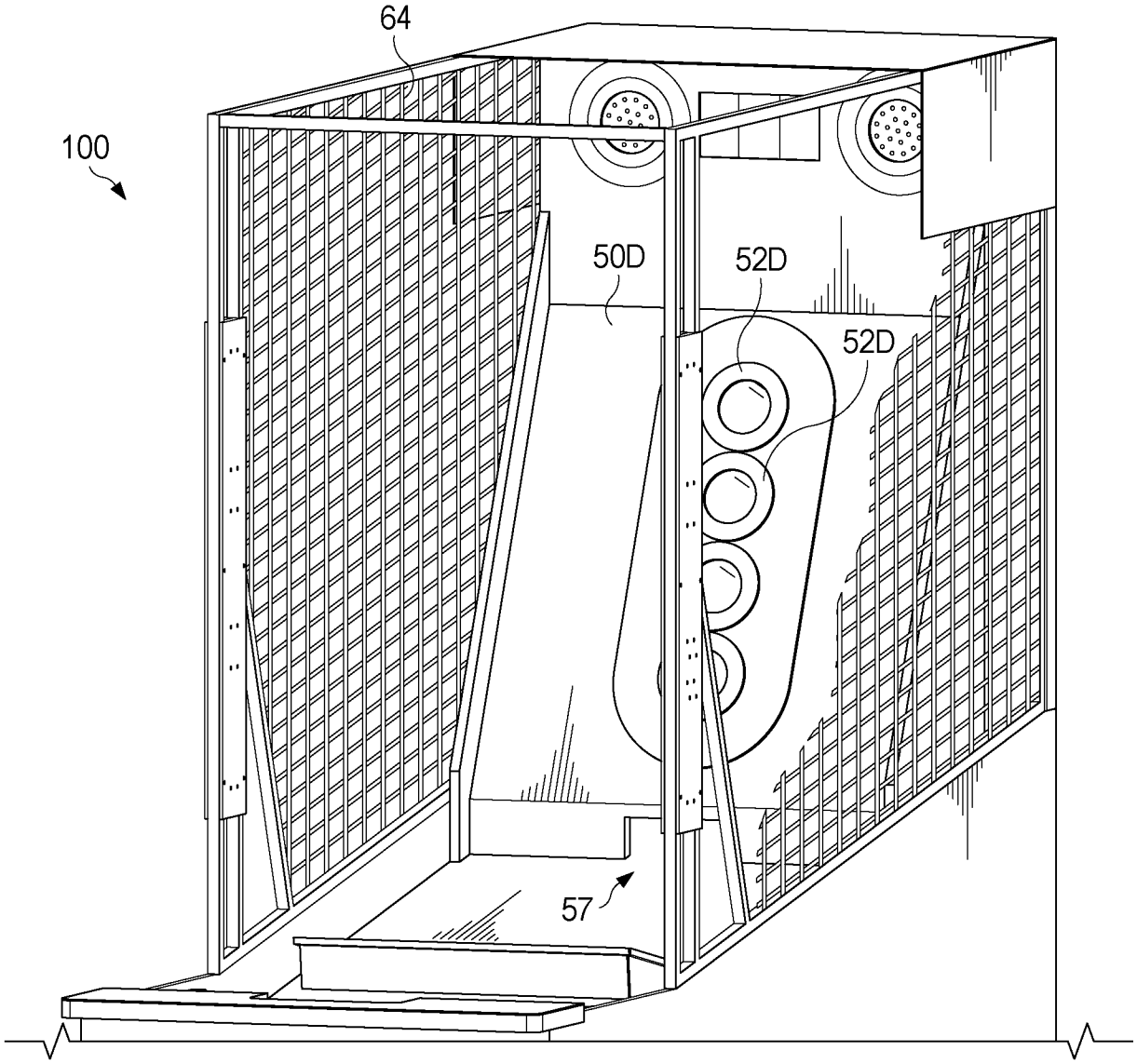
FIG. 8 is a front perspective view of a fourth exemplary embodiment of a midway-style electronic game machine.
Figure 9:
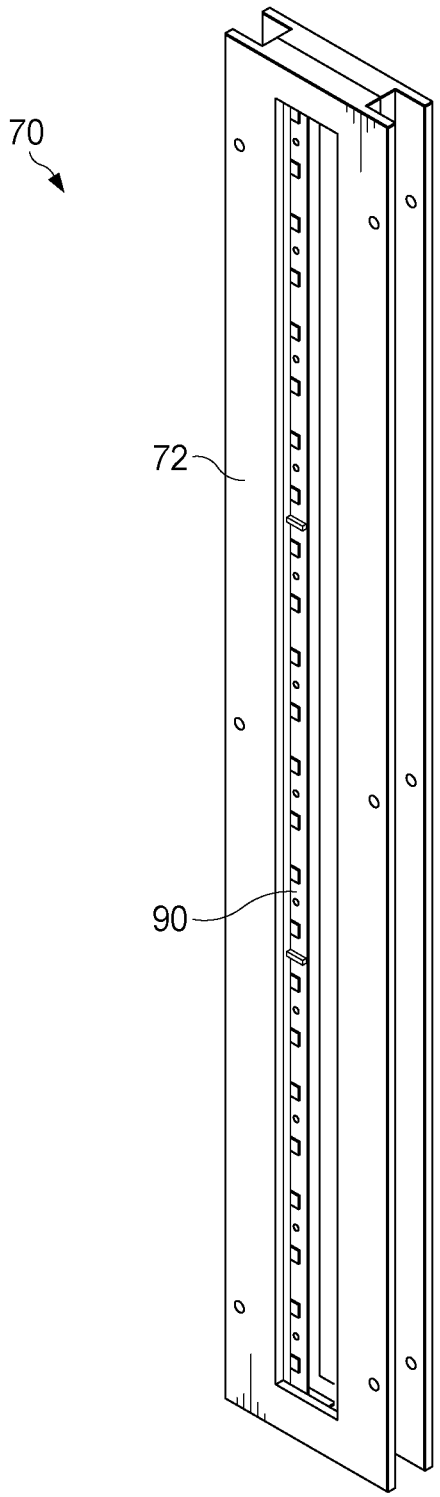
FIG. 9 is a front perspective view of a sensor array and housing.

In exemplary embodiments, the machine 100 may be provided with netting or caging 64 attached to the frame 60 that surrounds the target cabinet 50 and the passing lane 62 (e.g., FIGS. 6-8). The netting or caging 64 may thereby catch projectiles that ricochet off the target cabinet 50 and prevent the projectiles from ricocheting away from the machine 100.

The machine 100 is not limited to any particular kind of game projectile. Rather, it is contemplated that there may be a wide variety of projectiles that are suitable for use with the machine 100. Exemplary projectiles may include, balls, basketballs, darts, bean bags, and/ any other kind of projectile that is typically used in carnival or arcade games.

Referring to FIGS. 6-8, the machine 100 is not limited to any particular design for the target cabinet 50. Rather, the target cabinet 50 can include any type or combination of structures and objects that would be fun to launch/actuate a projectile at. The target cabinets 50A-50D shown in FIGS. 1 and 6-8 are each designed with a mind towards replicating the play experience of various attendant midway-style games. FIG. 1, for example, includes a generally upright cabinet 50A positioned at the highest point along the ramp section 40, furthest away from the counter section 30, that has a front-facing side featuring a plurality of targets for a player to aim at (here, a 4×4 grid of balloon illustrations 52A). The embodiments of FIGS. 6 and 7 are similar except that they have different kinds of targets—knock-down dolls 52B in FIG. 7 and a basketball hoop 52C in FIG. 8. The embodiment of FIG. 8 is likewise similar, but includes a slanted cabinet 50D and a vertical row of circular openings 52D for targets. The target cabinets 50B, 50D of FIGS. 6 and 8 feature an interior space for collecting projectiles from successful attempts, and a lower opening 56 that projectiles may pass through before traveling down the ramp section.

In exemplary embodiments, the machine 100 may also include one or more made-shot sensors integrated into the target cabinet 50 and connected to a target 52. These made-shot sensors (or more broadly, "success sensors", meaning any sensor known to those of ordinary skill in the art that detects a successful encounter by a user actuated game projectile with a target) may be configured to detect when a player successfully causes a game projectile to pass through a target opening, or successfully hit a target 52 (e.g., when a dart hits a balloon, or when a basketball passes through a hoop, or other carnival or arcade game contests known to those of ordinary skill in the art).

In exemplary embodiments, the machine 100 may include a display 54 integrated into the target cabinet 50 to convey information to the player. For example, the display 54 may present information such as number of attempts remaining, number of successful attempts, amount of time remaining, high scores, and the like.

In exemplary embodiments, the machine 100 may include speakers 56 integrated into the target cabinet 52 for playing audio (e.g., music and/or sounds) to enhance the interactive aspect of the machine (e.g., by providing audio feedback).

Figure 2:
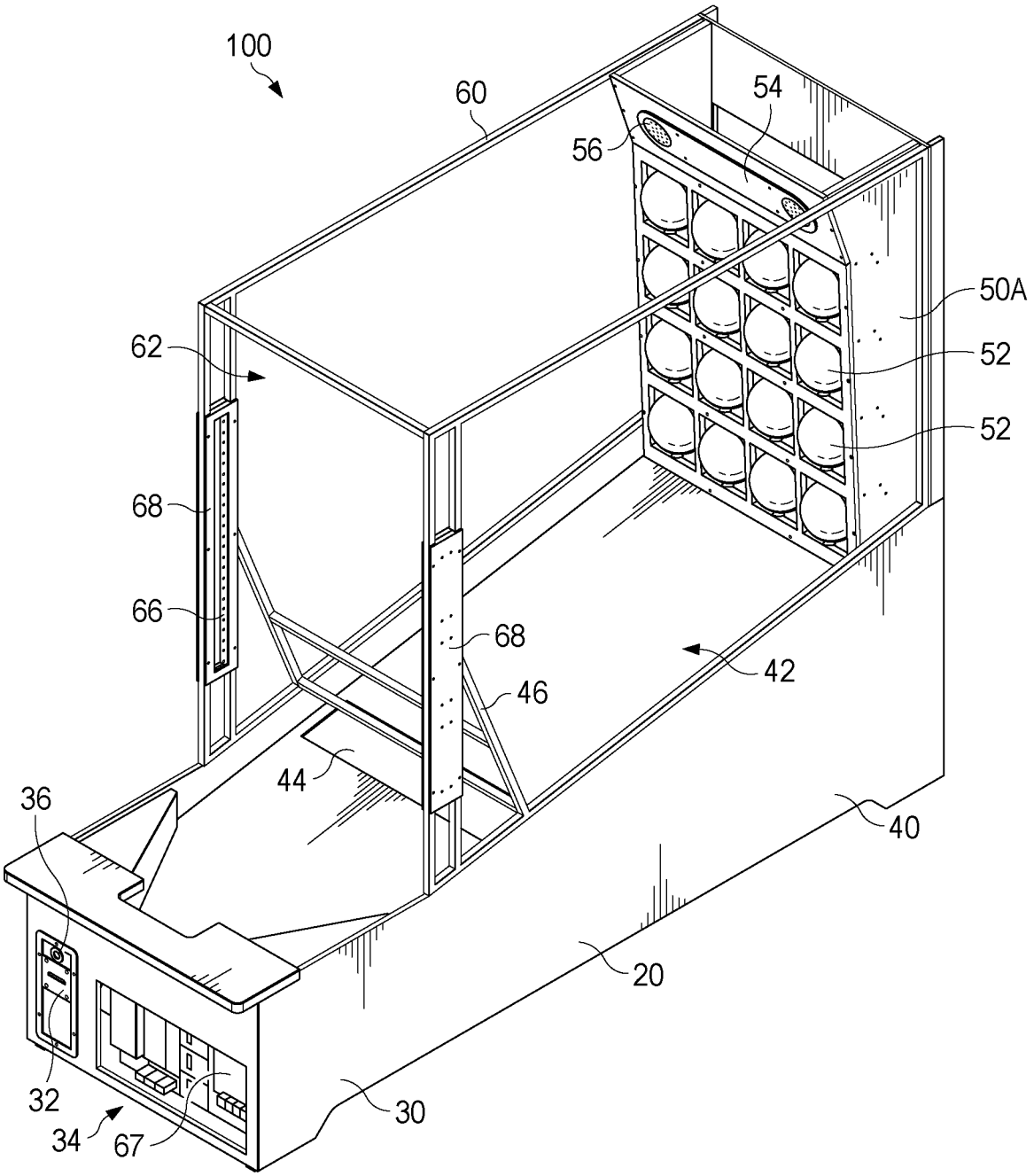
FIG. 2 is a top perspective view of the machine of FIG. 1.
Figure 3:
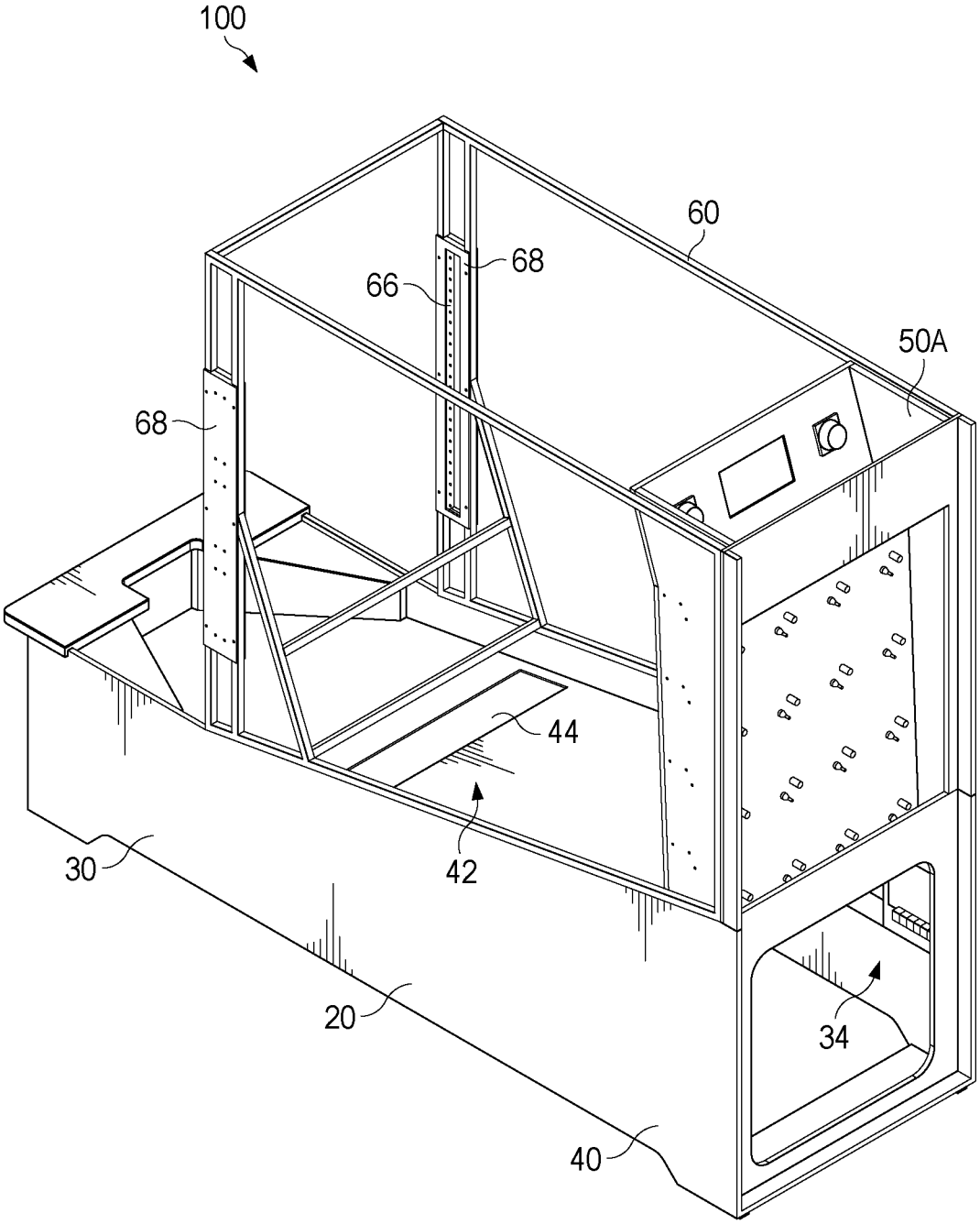
FIG. 3 is a rear perspective view of the machine of FIG. 1.
Figure 4:
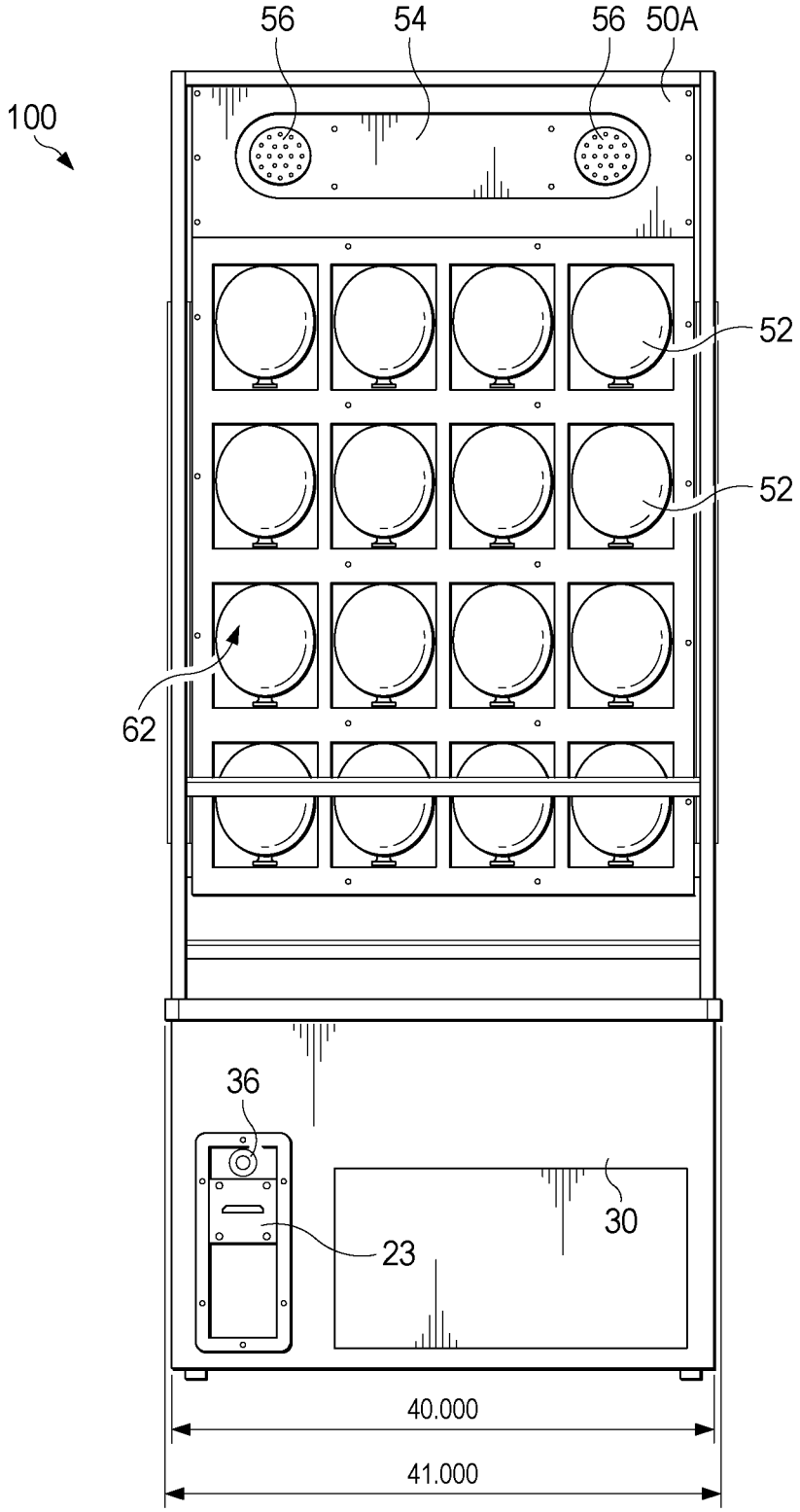
FIG. 4 is a front view of the machine of FIG. 1.
Figure 5:
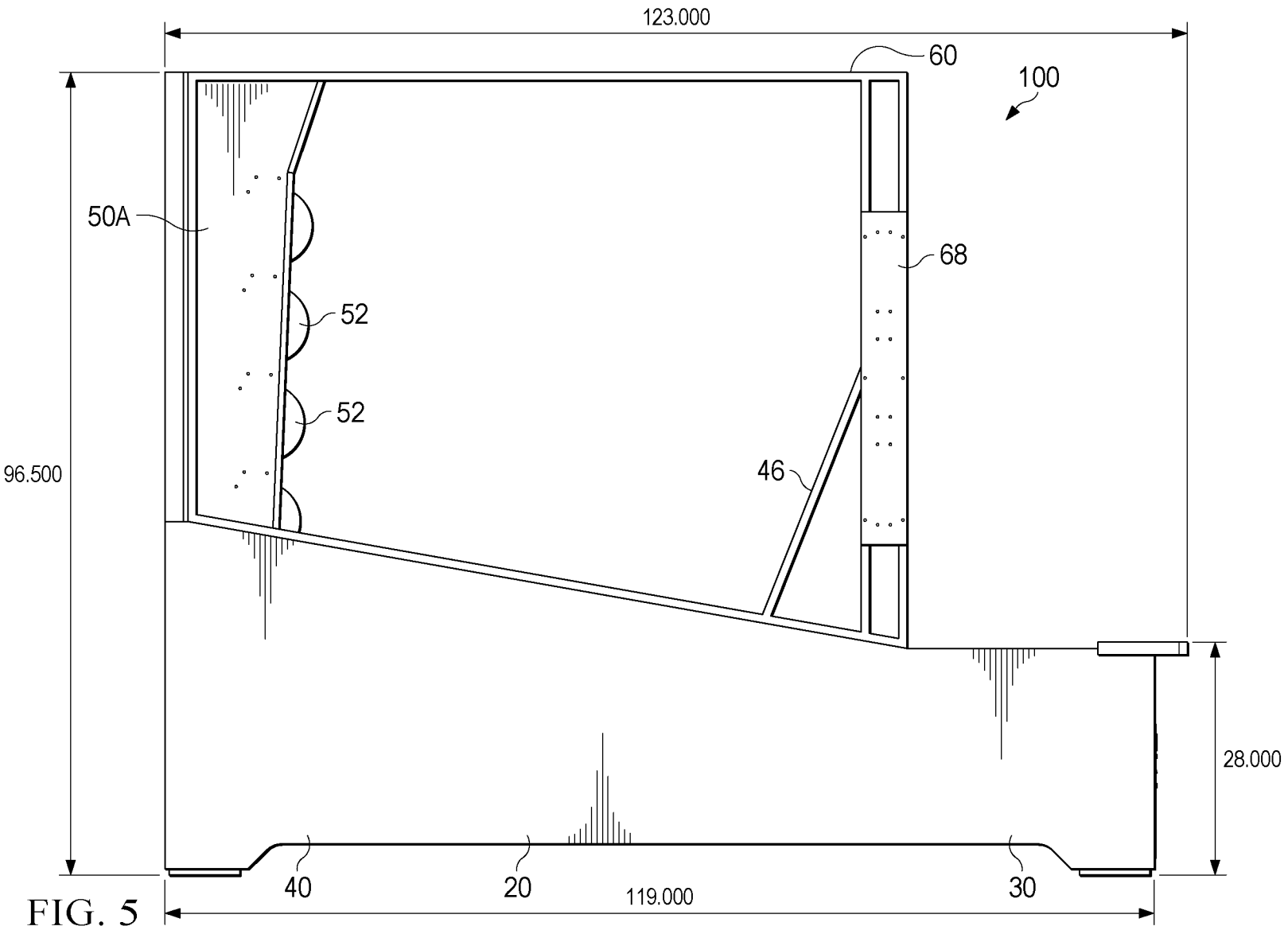
FIG. 5 is a side view of the machine of FIG. 1.

As shown in FIGS. 2 and 3, the machine 100 includes one or more control units 34 that may each comprise any suitable configuration of computing components and circuity (e.g., processors, memory, RAM, power supply, wireless communication protocols, etc.) required to enable the functions described in this disclosure, as well as the coordination and control of the various electronic components described in this disclosure, either individually or in coordination with one another (e.g., payment device 32, game start device 36, reward dispenser, gate 44, made-shot sensors, display 54, speakers 56, sensor arrays 66, etc.).

One issue with midway-style games, both here with the machine 100 and in traditional midway-style games, is the issue of players taking unauthorized attempts. This can occur if a player "rebound" (i.e., recaptures) a projectile that ricochets back to the player (e.g., through the passing lane) after an unsuccessful attempt and the player tries again. This can also occur if the player somehow secures an extra projectile, for instance, through underhanded means. Preventing such illicit player behavior is one reason why an attendant is usually required for midway-style games.

It is an object of the present invention to remove the need for an attendant. Towards that end, the machine 100 includes one or more detectors that may be in the form of sensor arrays 66 positioned near the passing lane 52 that are configured to detect the presence, movement, and direction of game projectiles passing through a detection area (e.g., passing lane 52).

Referring to FIG. 1, the present disclosure provides an exemplary embodiment of a sensor array configuration. Here, the machine 100 includes two opposing sensor array housings 68 vertically attached to the frame 60 near the counter section 30. The sensor array housings 68 house a plurality of sensor arrays 66 that are oriented facing the passing lane 52.

Referring to FIGS. 9-12, the present disclosure provides an exemplary embodiment of a sensor array configuration and housing 70, which may be representative of the sensor arrays 66 and housings 68 shown in FIG. 1. Here, the housing 72 is elongated in shape and features a two-piece design—an inner piece 74 that faces the passing lane 52, and an outer piece 76 that faces away from the passing lane 52. The outer piece 76 and inner piece 74 each include flanges 78 that enables the housing 72 to clamp onto the frame 60 when the two pieces 74, 76 are fitted together. The outer piece 76 includes a center portion 86 where the sensor arrays 90 may be mounted. The inner piece 74 includes a center portion 84 that defines an opening 82 for receiving the sensor arrays 90 and enabling the transmission and receipt of signals. In preferred embodiments, the opening 82 of the inner piece 74 may also be provided with a window 80 for added protection for the sensor arrays 90 (best shown in FIGS. 6-8).

Figure 10:
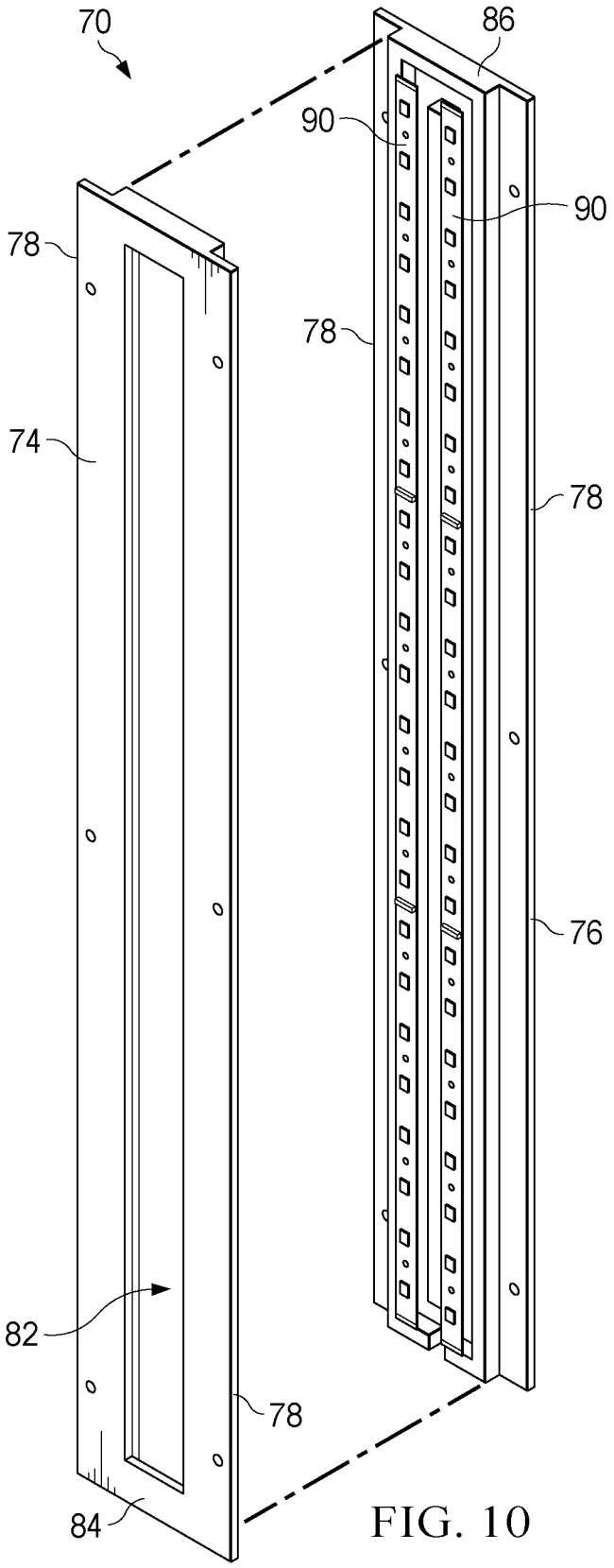
FIG. 10 is an exploded front perspective view of the sensor array and housing of FIG. 13.
Figure 11:
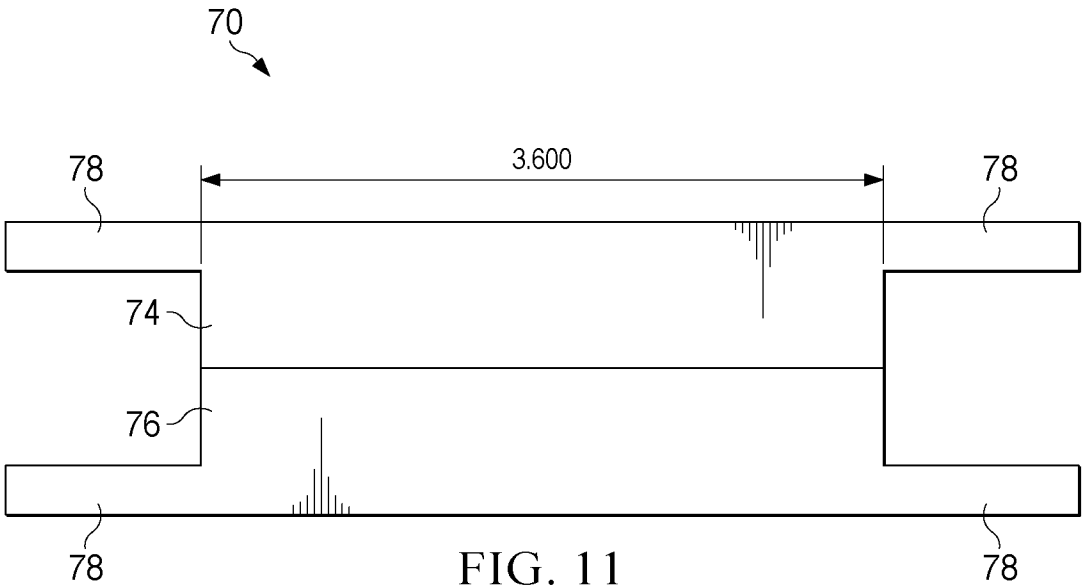
FIG. 11 is a top view of the sensor array housing of FIG. 10.
Figure 12:
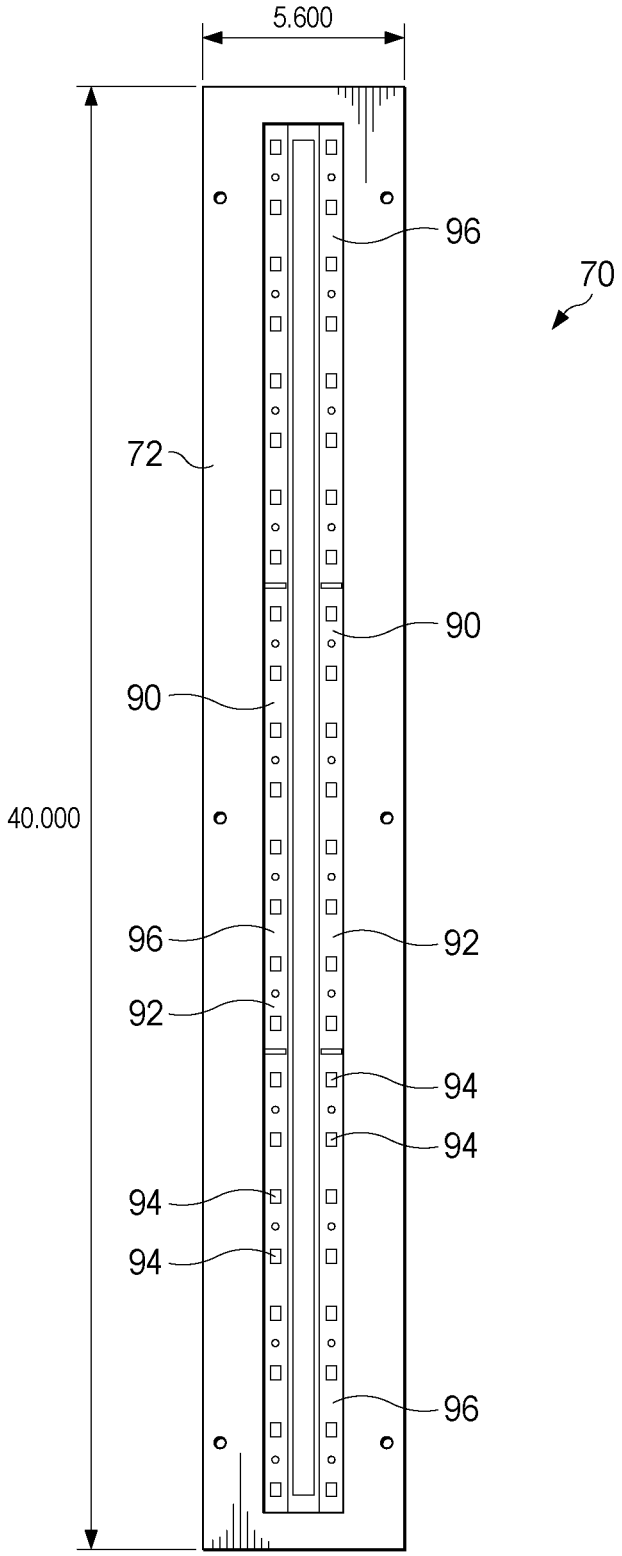
FIG. 12 is a front view of the sensor array and housing of FIG. 10.

Referring to FIG. 10, the outer piece 76 may have two linear sensor arrays 90 mounted to it. The sensor arrays 90 may be oriented parallel to one another and may extend along the length of the housing 72. By this design, the machine 100 of FIG. 1 would have four sensor arrays 66 in total between the two housings 68.

Each sensor array 90 comprises a printed circuit board (PCB) 92 with a plurality of sensor components 94 (e.g., transmitters and receivers) installed on it. It is generally contemplated that the sensor arrays need not be limited to any particular type of sensing technology, and that any suitable type of sensor component may be installed. In a preferred embodiment, the sensor array may include infrared sensor components.

The sensor array PCB can be a single PCB or a collection of several smaller PCBs. In the embodiment shown, the sensor array includes three sensor array units 96 aligned in a row, each having eight equally spaced sensor components 94 attached thereto. It is contemplated that the length of any sensor array can be lengthened or shortened as needed by either adding or removing one or more of these sensor array units 96.

Referring back to FIG. 1, in this embodiment each sensor array 66 is configured to operate with the sensor array 66 directly opposite to it (i.e., in the opposite housing 68). For example, a sensor array in one housing may include sensor components that are all transmitters; and the sensor array in the opposite housing may include sensor components that are all receivers. In effect, this sensor array configuration would result in two parallel detection planes (i.e., the "detection areas") located between the two housings 68, each comprising a vertical cross-section of the passing lane 62. By detecting interruptions in these detection planes, the sensor arrays 66 may be able to detect the presence, movement, and direction of projections passing through the passing lane 62. One way of doing so may involve determining a sequence in which the sensor arrays detect interruptions in the detection planes (i.e., which one detects the same interruption first indicates which direction a projectile's trajectory follows through the passing lane 62). If, for example, the counter-side detection plane gets interrupted first followed by an interruption in the target-side detection plane, then that may indicate that a player has thrown a projectile from the counter section towards the target cabinet. If the reverse is true, then that may indicate that a projectile has inadvertently ricocheted back towards the counter section from the target cabinet (and can thereby be properly accounted for).

In exemplary embodiments, the sensor array(s) 66 may be operatively connected to a control unit 67 (or electronic controller) in communication with the detector(s), which may be configured to count the number of projectiles that pass though the passing lane 52 and automatically end a game play session once a user has actuated the predetermined number of game projectiles toward the target. This can be for either direction (i.e., either from the counter section 30 to the target cabinet 50 or from the target cabinet 50 to the counter section 30). In a preferred embodiment, however, the sensor array(s) 66 and a control unit may be configured to count the projectiles moving in the direction of the player to the target cabinet 50, and not count the projectiles that move in the reverse direction (from the target cabinet 50 back to the player). It is contemplated that this functionality may enable the machine 100 to detect and recognize a correct number of attempts that a player is authorized to make, while disregarding any unauthorized attempts. It is contemplated that by this functionally, an attendant is no longer need for the administration of midway-style games.

In the embodiment of FIGS. 1-5, the sensor arrays are linear and arranged vertically relative to the passing lane. Although this configuration is considered exemplary, it is not meant to be limiting. It is contemplated that in other embodiments, the sensor arrays may be linear and oriented horizontal relative to the passing lane. Alternatively, the sensor arrays may be curved or arc-shaped, thereby resulting in circular or ovoid detection planes. Variations such as these will not result in a departure from the scope of the present disclosure.

The embodiment of FIGS. 1-5 features an opposing sensor array configuration wherein one sensor array functions as a transmitter and the other sensor array functions as a receiver (with the two sensor arrays collectively generating a detection plane). It is contemplated that single sensor array confirmations may also be utilized. Such a sensor array configuration may include, for example, a single sensor array that is equipped with both transmitting and receiving components such that an opposing second sensor is not required. Variations such as this will not result in a departure from the scope of the present disclosure.

The embodiment of FIGS. 1-5 features a sensor array configuration featuring parallel rows of sensor arrays which results in parallel detection planes. It is contemplated that senor array configurations that cover non-parallel detection areas may also be utilized. These sensor array configurations may entail, for example, non-liner arrangements of transmitters and receivers. Variations such as these will not result in a departure from the scope of the present disclosure.

Figure 13:
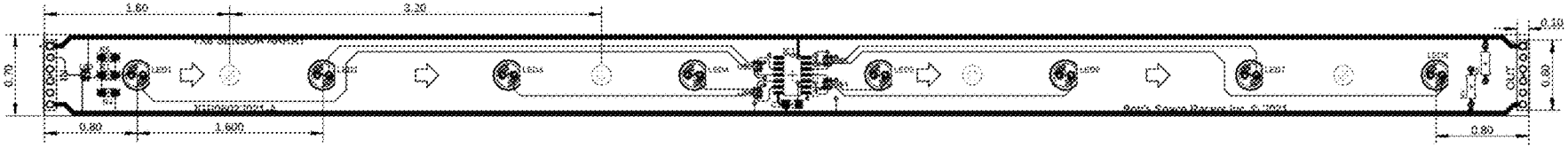
FIG. 13 is a front view of a first exemplary embodiment of a sensor array unit.
Figure 14:
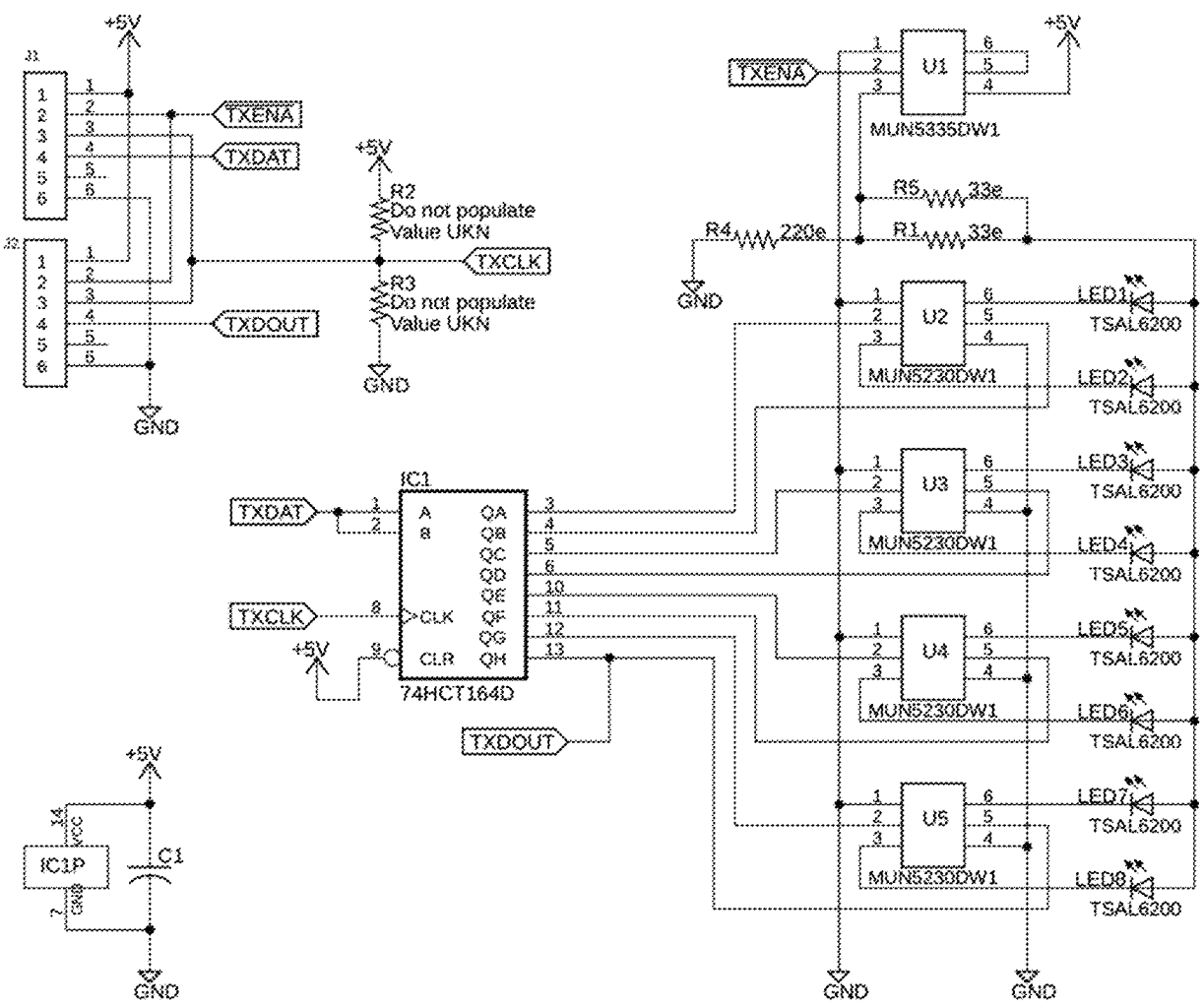
FIG. 14 is an electronic circuit diagram for the sensor array unit of FIG. 13.

Referring to FIGS. 13 and 14, the present disclosure provides an exemplary embodiment of a sensor array unit 98. FIG. 17 shows a schematic diagram for this sensor array unit 98 and FIG. 19 shows an electronic circuit diagram for the same. Here, all of the sensor components are infrared transmitters. An exemplary sensor component that may be utilized in this design can include, for example, the TSAL-6200 available from Vishay Intertechnology, Inc. of Malvern Pa.

Figure 15:
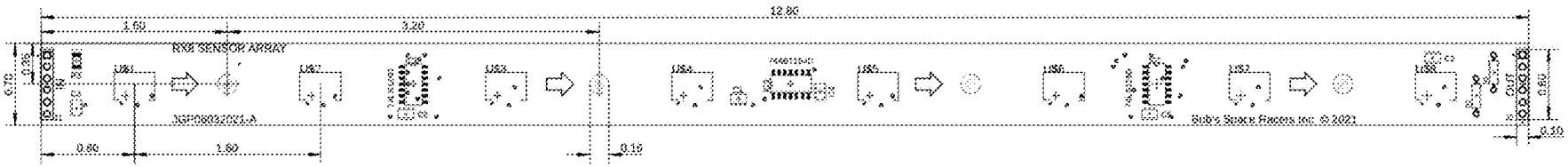
FIG. 15 is a front view of a second exemplary embodiment of a sensor array unit.
Figure 16:
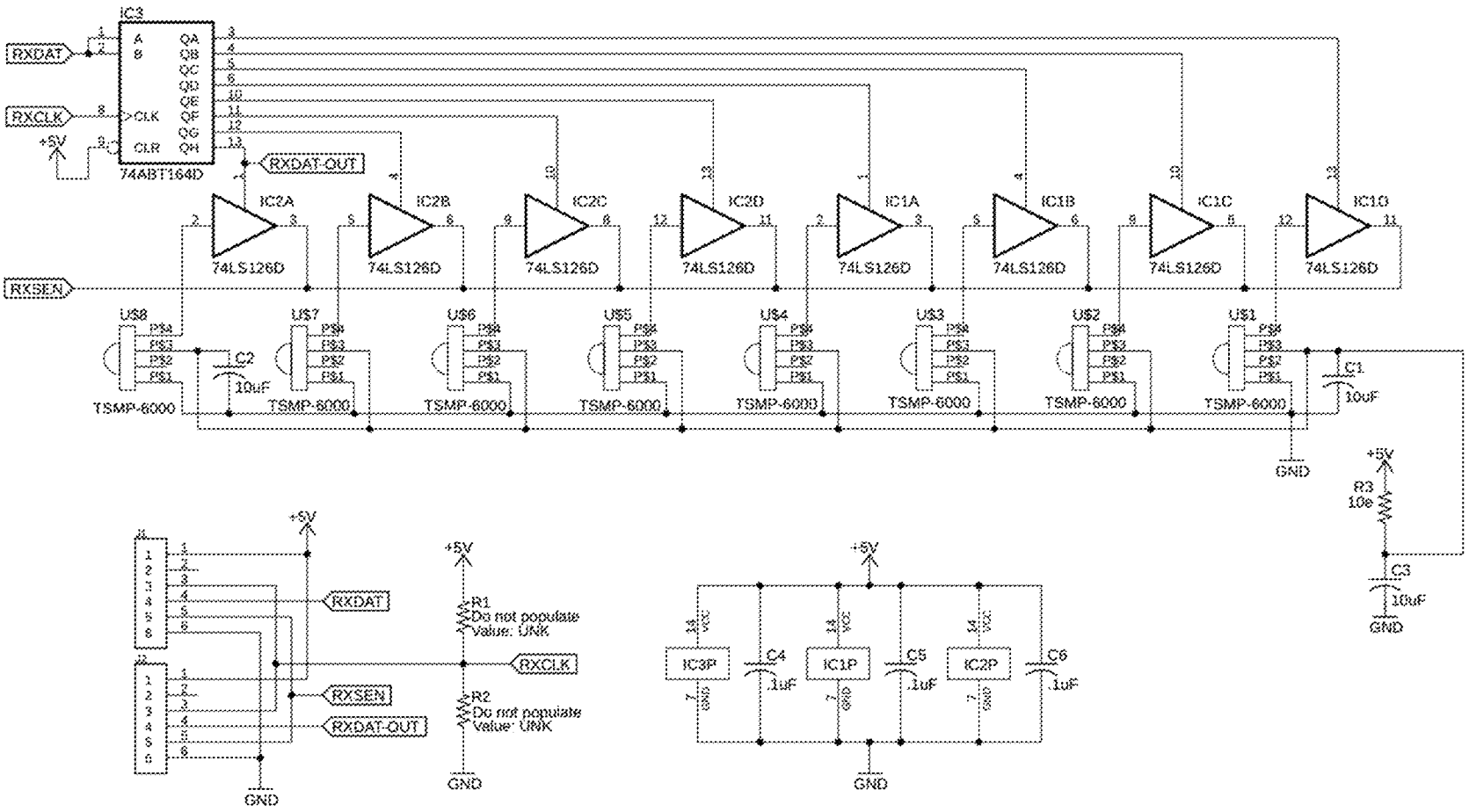
FIG. 16 is an electronic circuit diagram for the sensor array unit of FIG. 14.

Referring to FIGS. 15 and 16, the present disclosure provides an exemplary embodiment of a sensor array unit 99. FIG. 18 shows a schematic diagram for this sensor array unit 99 and FIG. 20 shows an electronic circuit diagram for the same. Here, all of the sensor components are infrared receivers. An exemplary sensor component that may be utilized in this design can include, for example, the TSMP-6000 available from Vishay Intertechnology, Inc. of Malvern Pa. Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A game machine comprising:
- a lower cabinet comprising a counter section and an elongated ramp section, with the ramp section extending backwards relative to the counter section;
- a target cabinet located on top of the ramp section and spaced a distance from the counter section;
- a first sensor array positioned proximate the bottom of the ramp that is configured to:
  - establish a first detection plane near the rear of the counter section; and
  - detect when an interruption occurs in the first detection area;
- a second sensor array is attached on a housing with the first sensor array, the second sensor array is configured to:
  - establish a second detection plane near the rear of the counter section in-between the first detection area and the target cabinet; and
  - detect when an interruption occurs in the second detection area; and
- a control unit operatively connected to the first sensor array and the second sensor array, wherein the control unit is configured to determine the direction a projectile is traveling based on the sequence in which the projectile interrupts the first detection plane and the second detection plane.

2. The game machine of claim 1, further comprising a frame above the lower cabinet that defines a passing lane between the counter section and the target cabinet.

3. The game machine of claim 2, further comprising at least one of netting and caging that surrounds the passing lane and is attached to the frame.

4. The game machine of claim 3, further comprising the housing that attaches the first and second sensor arrays to the frame.

5. The game machine of claim 1, wherein the first and second sensor arrays each comprise an infrared sensor.

6. The game machine of claim 1, further comprising a gate between the counter section and the target cabinet, the gate being configured to prevent projectiles from traveling down the ramp section to the counter section.

7. The game machine of claim 6, wherein the gate is integrated into the ramp section.

8. The game machine of claim 1, wherein the target cabinet comprises a display configured to present information to a player.

9. The game machine of claim 1, wherein the counter section comprises a payment device configured to receive payment from a player.

10. The game machine of claim 1, wherein the counter section comprises a reward dispenser for dispensing rewards earned for playing the game machine.

11. The game machine of claim 1, wherein the control unit is further configured to count sequences where the first detection plane is interrupted before the second detection plane.

12. The game machine of claim 1, wherein the control unit is further configured to disregard sequences where first detection plane is interrupted after the second detection plane.

13. A game apparatus comprising:

an interactive game machine, including a plurality of game projectiles;

said interactive game machine having a first structural portion, said first structural portion adapted to present a predetermined number of said game projectiles proximal to a user play position for a game play session, said game projectiles adapted to be individually actuated by a user;

a second structural portion comprising a target distally located from a user play position, said target adapted for contact with said user actuated game projectiles, and a success sensor operatively connected to the target for detecting when a user has made a successful attempt in getting one of said game projectiles to successfully encounter said target;

a first detector and a second detector located at said first structural portion, near said user play position, said first and second detectors are configured to detect each of said game projectiles passing by said first and second detectors;

a controller in electronic communication with said first and second detectors, said controller adapted to count said predetermined number of said game projectiles by said first and second detectors that pass by said first and second detectors, and said controller is further adapted to automatically end said game play session once said predetermined number of game projectiles is detected.

14. The game machine of claim 13, wherein the target comprises a basketball hoop.

15. The game machine of claim 13, wherein the target comprises a knock- down doll.

16. The game machine of claim 13, wherein the target comprises an opening in the target cabinet.

17. The game machine of claim 13, wherein said first and second detectors each comprise a sensor array.

* * * * *